US008041265B2

(12) United States Patent
Shimomura

(10) Patent No.: US 8,041,265 B2
(45) Date of Patent: Oct. 18, 2011

(54) IMAGE FORMING UNIT WITH MOVABLE MEMBER AND IMAGE FORMING APPARATUS

(75) Inventor: Tatsuhiko Shimomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 468 days.

(21) Appl. No.: 12/003,898

(22) Filed: Jan. 3, 2008

(65) Prior Publication Data

US 2008/0170886 A1 Jul. 17, 2008

(30) Foreign Application Priority Data

Jan. 15, 2007 (JP) ..... 2007-006024

(51) Int. Cl.
*G03G 15/08* (2006.01)

(52) U.S. Cl. ..... 399/258; 399/120

(58) Field of Classification Search ..... 399/120, 399/258, 260, 261, 262
See application file for complete search history.

(56) References Cited

U.S. PATENT DOCUMENTS 5,270,785 A * 12/1993 Kita et al. ..... 399/261
5,995,789 A * 11/1999 Murakami et al. ..... 399/262

FOREIGN PATENT DOCUMENTS

| | | |
|---|---|---|
| JP | 63-197978 | 8/1988 |
| JP | 2002-236410 | 8/2002 |
| JP | 2004-046011 | 2/2004 |
| JP | 2004-093924 | 3/2004 |
| JP | 2004-317846 | 11/2004 |
| JP | 2005-189692 | 7/2005 |

* cited by examiner

*Primary Examiner* — David Gray
*Assistant Examiner* — Joseph Wong
(74) *Attorney, Agent, or Firm* — Kubotera & Associates, LLC

(57) ABSTRACT

An image forming unit includes an image forming unit main body; and a developer storage unit detachably attached to the image forming unit main body. The image forming unit main body includes a developer retaining space for retaining developer and a supply opening for supplying developer to the developer retaining space. The developer storage unit includes a discharge opening for discharging developer to the developer retaining space. The image forming unit main body further includes a movable member moving relative to the discharge opening and the supply opening.

17 Claims, 9 Drawing Sheets

IMAGE FORMING UNIT WITH MOVABLE MEMBER AND IMAGE FORMING APPARATUS

BACKGROUND OF THE INVENTION AND RELATED ART STATEMENT

The present invention relates to an image forming unit and an image forming apparatus.

A conventional image forming apparatus such as a printer, a copier, a fax machine, and a multifunction product thereof is provided with an image forming unit. In the image forming unit, a surface of a photoreceptor drum is charged constantly and evenly, and the surface of the photoreceptor drum is exposed to form an electrostatic latent image thereon. A developing roller develops the electrostatic latent image to form a toner image, and the toner image is transferred to a sheet. Then, the toner image is fixed on the sheet, thereby forming an image.

When the image forming unit forms an image repeatedly, toner as developer is consumed. Accordingly, a toner cartridge as a developer storage unit for retaining toner is disposed separately from a main body of the image forming unit or an image forming unit main body. When an amount of toner becomes low, it is possible to exchange the toner cartridge with a new toner cartridge, thereby replenishing toner.

The toner cartridge is provided with a discharge opening and a shutter at a position corresponding to a supply opening of the image forming unit main body. After the toner cartridge is attached to the image forming unit main body, the shutter is opened or a seal is opened, so that toner is supplied to the image forming unit main body.

In the toner cartridge, a stirring member may be disposed for stabilizing toner thus supplied and stably supplying toner to a developing unit (refer to Patent Reference).

Patent Reference Japanese Patent Publication No. 2004-93924

In a conventional printer, when a discharge opening or a supply opening has a large size, a toner cartridge or an image forming unit main body tends to have low rigidity, or toner may leak to outside. Accordingly, it is difficult to increase a size of the discharge opening or the supply opening.

When a density of toner increases due to vibrations during transportation or own weight, toner in the toner cartridge loses flowability. Accordingly, toner tends to be clogged near the discharge opening or the supply opening, thereby making it difficult to stir toner near the discharge opening. As a result, it is difficult to supply a sufficient amount of toner from the toner cartridge to the image forming unit main body, thereby causing a blurred image and lowering image quality.

In the view of the problems described above, an object of the present invention is to provide an image forming unit and an image forming apparatus capable of solving the problems and supplying a sufficient amount of toner from a toner cartridge to an image forming unit main body, thereby improving image quality.

Further objects and advantages of the invention will be apparent from the following description of the invention.

SUMMARY OF THE INVENTION

In order to attain the objects described above, according to the present invention, an image forming unit includes an image forming unit main body; and a developer storage unit detachably attached to the image forming unit main body. The image forming unit main body includes a developer retaining space for retaining developer and a supply opening for supplying developer to the developer retaining space. The developer storage unit includes a discharge opening for discharging developer to the developer retaining space. The image forming unit main body further includes a movable member moving relative to the discharge opening and the supply opening.

In the present invention, the image forming unit main body includes the movable member moving relative to the discharge opening and the supply opening. Accordingly, even when a density of developer increases due to vibrations during transportation or own weight, and developer in the developer storage unit loses flowability, it is possible to prevent developer from being clogged near the discharge opening or the supply opening. As a result, it is possible to supply a sufficient amount of developer from the developer storage unit to the image forming unit main body, thereby preventing a blurred image and improving image quality.

DETAILED DESCRIPTION OF THE PREFERRED EMBODIMENTS

Hereunder, embodiments of the present invention will be explained with reference to the accompanying drawings. In the description below, a printer is described as an example of an image forming apparatus.

First Embodiment

Figure 1:
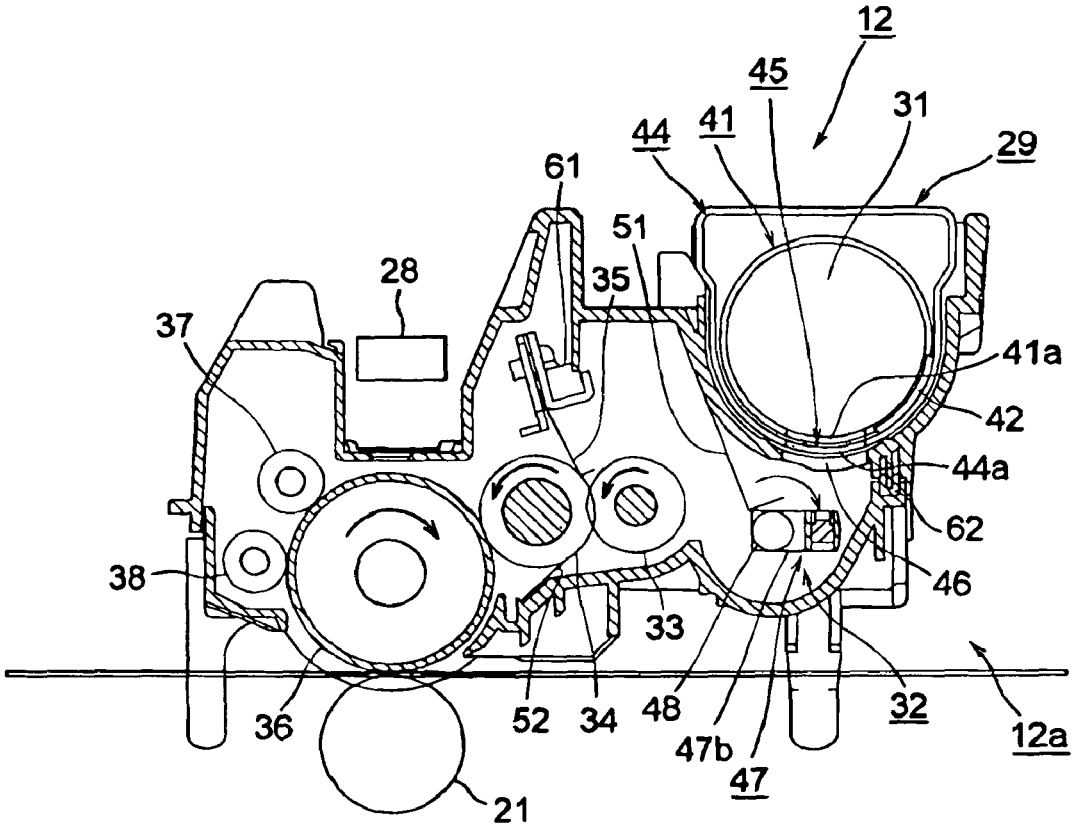
FIG. 1 is a sectional view showing an image forming unit according to a first embodiment of the present invention.
Figure 2:
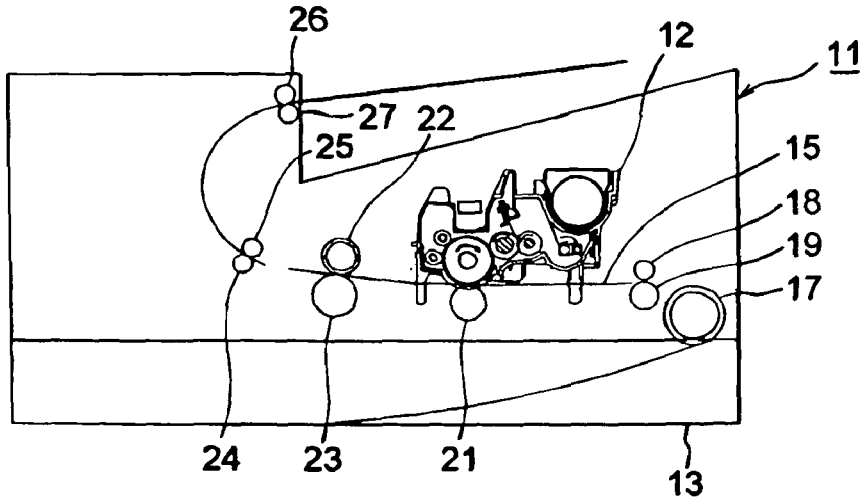
FIG. 2 is a schematic view showing a printer according to the first embodiment of the present invention.
Figure 3:
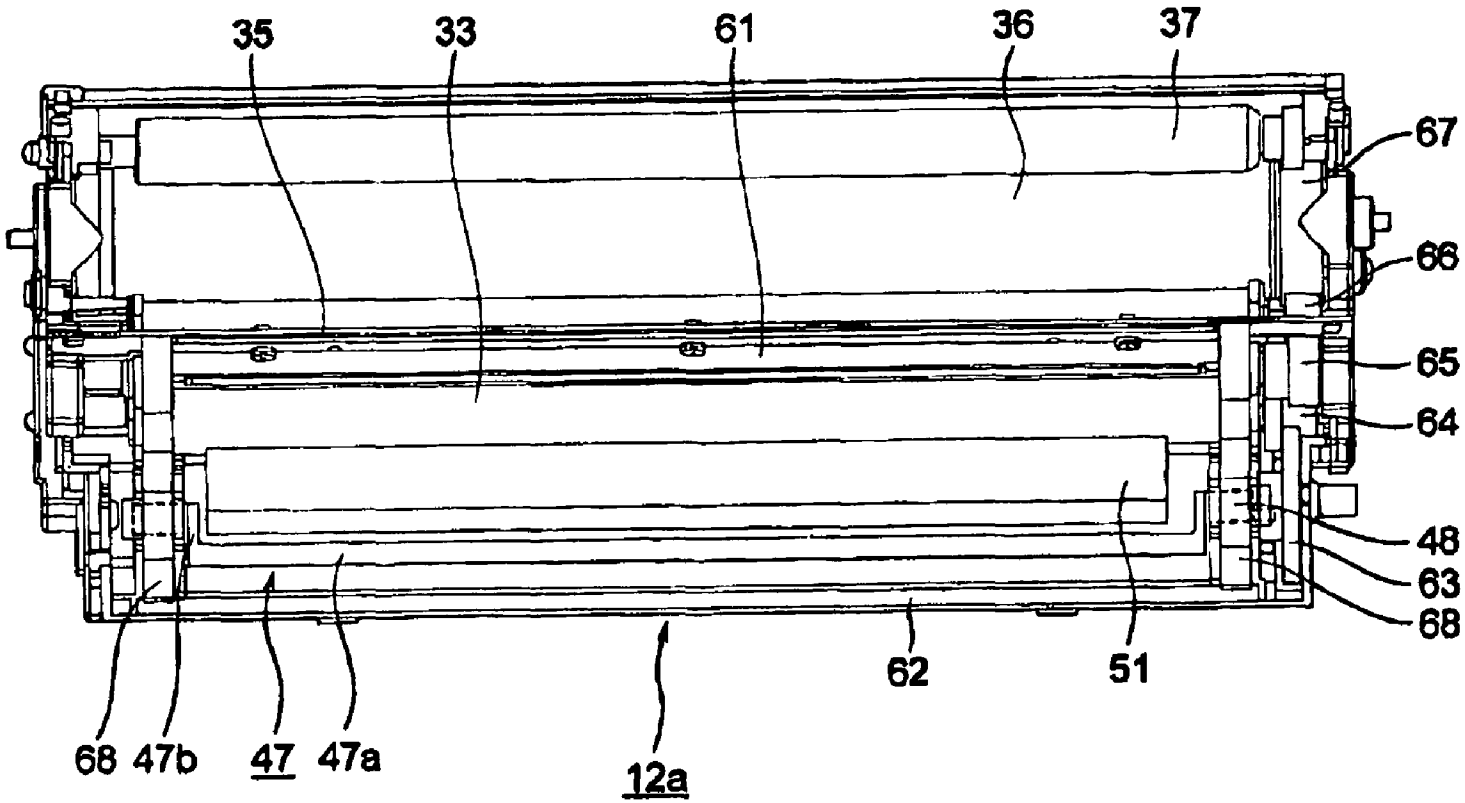
FIG. 3 is a plan view showing the image forming unit according to the first embodiment of the present invention.

A first embodiment of the present invention will be explained. FIG. 1 is a sectional view showing an image forming unit 12 according to the first embodiment of the present invention. FIG. 2 is a schematic view showing a printer 11 according to the first embodiment of the present invention. FIG. 3 is a plan view showing the image forming unit 12 according to the first embodiment of the present invention.

As shown in FIG. 2, the printer 11 is provided with the image forming unit 12 detachably attached to a main body of the printer 11 or a printer main body; a cassette 13 for storing a sheet 15 as a medium; a hopping roller 17 as a picking up member; a transfer roller 21 as a transfer member; a fixing roller 22 as a first roller; a back-up roller 23 as a second roller; and an LED (Light Emitting Diode) head 28 as an exposure unit supported on the printer main body with a holder (not shown). In the printer 11, the fixing roller 22 and the back-up roller 23 constitute a fixing unit or a fixing device.

When the hopping roller 17 rotates to pick up the sheet 15 from the cassette 13, a sheet supply mechanism formed of register rollers 18 and 19 transports the sheet 15 to a space between the image forming unit 12 and the transfer roller 21. Then, the image forming unit 12 forms a toner image as a developer image, and the transfer roller 21 transfers the toner image to the sheet 15. Afterward, the sheet 15 is transported to the fixing device, and the fixing device fixes the toner image to the sheet 15, thereby forming an image. After forming the image, discharges rollers 24 to 27 discharge the sheet 15.

In the embodiment, the image forming unit 12 includes an image forming unit main body 12*a* and a toner cartridge 29 as a developer storage unit detachably attached to the image forming unit main body 12*b*. A toner storage space 31 is formed inside the toner cartridge 29 as a developer storage space, so that toner (not shown) as developer is stored in the toner storage space 31.

Further, the toner cartridge 29 includes an inner cylindrical member 41 and an outer cylindrical member 44 disposed outside the inner cylindrical member 41. The inner cylindrical member 41 has an opening portion 41*a*, and the outer cylindrical member 44 has an opening portion 44*a*. The opening portions 41*a* and 44*a* constitute a discharge opening 45 for discharging toner in the toner storage space 31.

In the embodiment, the image forming unit main body 12*a* includes a photosensitive drum 36; a charging roller 37 as a charging device contacting with the photosensitive drum 36; a developing roller 34 as a toner supporting member contacting with the photosensitive drum 36 for holding toner; a toner supply roller 33 as a supply member contacting with the photosensitive drum 36 for supplying toner to the developing roller 34; a blade 35 as a regulation member; a cleaning roller 38 as a cleaning device; and the likes.

Further, the image forming unit main body 12*a* includes a supply opening 46 corresponding to the discharge opening 45 for supplying toner. After the toner cartridge 29 is attached to the image forming unit main body 12*a*, when a lever (not shown) as an operation member integrated with the inner cylindrical member 41 is rotated, a shutter 42 as a seal member formed of an elastic member rotates. Accordingly, toner is supplied to a toner retaining space 32 as a developer retaining space through the discharge opening 45 and the supply opening 46.

In the embodiment, a toner stirring member 47 having an arm shape is disposed in the toner retaining space 32 as a rotational mechanism or a stirring mechanism. The toner stirring member 47 is arranged to be rotatable around a shaft 48 in an arrow direction (clockwise direction) in FIG. 1. Further, a film member 51 having a plate shape is disposed in the toner retaining space 32 adjacent to the toner stirring member 47 as a movable member or a flexible member. The film member 51 is formed of a flexible material, and is arranged to be rotatable with a rotation of the toner stirring member 47.

When toner is supplied to the image forming unit main body 12*a*, the toner stirring member 47 and the film member 51 stir toner. Then, the toner supply roller 33 supplies toner to the developing roller 34, so that the blade 35 forms a thin layer of toner on a surface of the developing roller 34. A film member 52 as a first seal member abuts against the developing roller 34 for preventing toner from leaking from the toner retaining space 32.

As described above, the toner stirring member 47 has the functions of stirring toner in the toner retaining space 32 and supplying toner to the toner supply roller 33. Similar to the toner stirring member 47, the film member 51 has the function of supplying toner to the toner supply roller 33 through a rotation thereof. Sponge members 61 and 62 are disposed as a second seal member for preventing toner from leaking outside the image forming unit main body 12*a*.

In the embodiment, the developing roller 37 charges a surface of the photosensitive drum 36 uniformly and evenly, and the LED head 28 selectively exposes the surface of the photosensitive drum 36 to form a static latent image thereon. Then, the developing roller 34 develops the static latent image to form the toner image. The transfer roller 21 transfers the toner image to the sheet 15. After the transfer roller 21 transfers the toner image, the cleaning roller 38 removes toner remaining on the photosensitive drum 36. Note that FIG. 3 is a plan view of the image forming unit main body 12*a* viewed from above, and the toner cartridge 29 and an upper frame of the image forming unit main body 12*a* are not shown.

In the embodiment, the toner stirring member 47 includes the shaft 48; a rod member 47*a* extending in parallel to the shaft 48, the toner supply roller 33, the photosensitive drum 36, and the developing roller 34; and a connecting member 47*b* connecting both end portions of the shaft 48 and the rod member 47*a*. Further, the toner stirring member 47 receives drive through a gear 63 as a rotation transmission member.

In a printing operation, the gear 63 is driven to rotate through a drive gear of the image forming unit 12, a gear 67 attached to a shaft of the photosensitive drum 36, a gear 66 attached to a shaft of the developing roller 34, an idle gear 65, and a gear 64 attached to a shaft of the toner supply roller 33.

In the embodiment, sponge members 64 are disposed on both end portions of the toner stirring member 47 as a third seal member. Similar to the sponge members 61 and 62, the sponge members 64 form closed spaces together with the image forming unit 12 and the film member 52 for preventing toner from leaking outside the image forming unit main body 12*a*.

Figure 4:
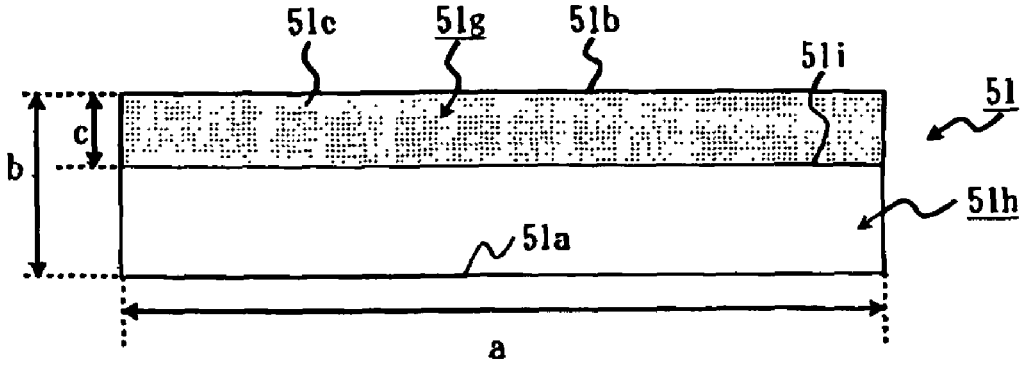
FIG. 4 is a schematic front view showing a film member according to the first embodiment of the present invention.
Figure 5:
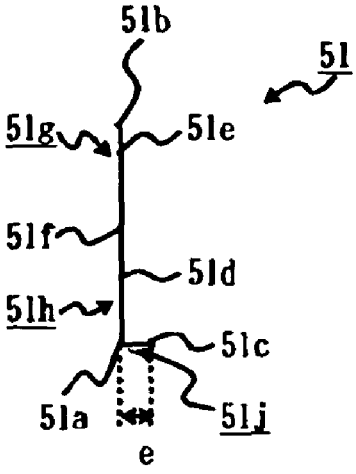
FIG. 5 is a schematic side view showing the film member according to the first embodiment of the present invention.
Figure 6:
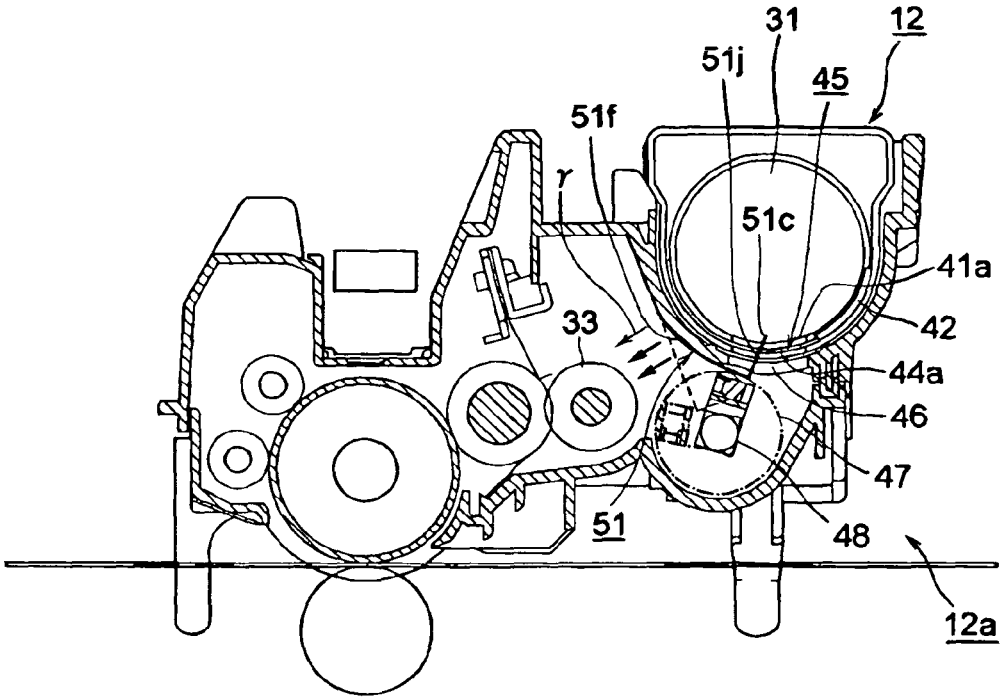
FIG. 6 is a sectional view No. 1 of the image forming unit showing an operation of the film member according to the first embodiment of the present invention.
Figure 7:
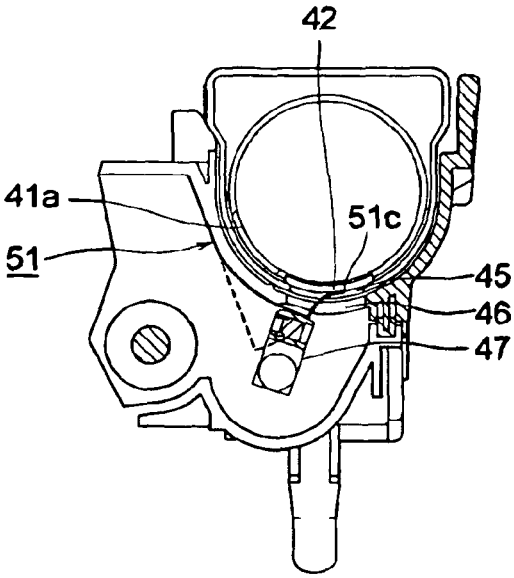
FIG. 7 is a sectional view No. 2 of the image forming unit showing the operation of the film member according to the first embodiment of the present invention.
Figure 8:
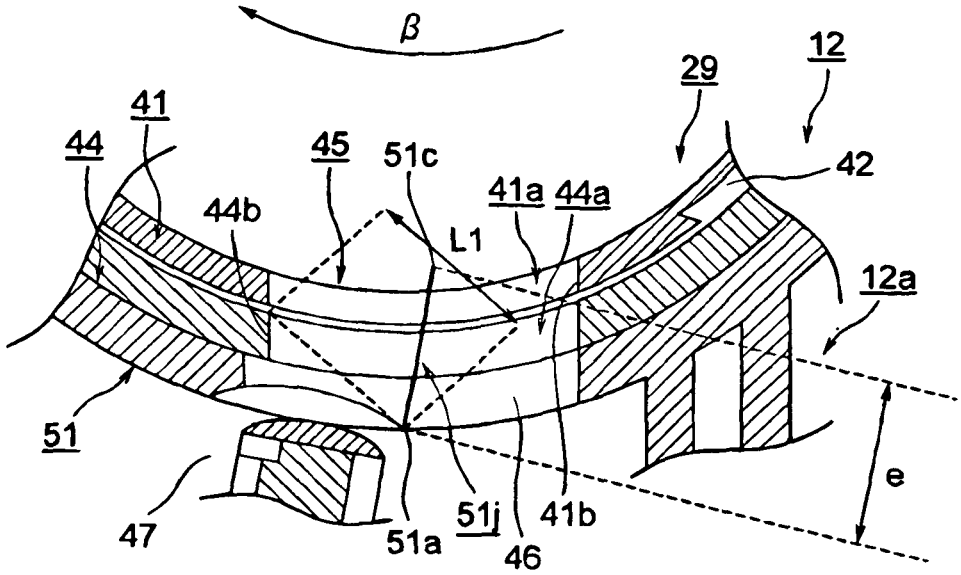
FIG. 8 is an enlarged view of the image forming unit showing the operation of the film member according to the first embodiment of the present invention.

FIG. 4 is a schematic front view showing the film member 51 according to the first embodiment of the present invention. FIG. 5 is a schematic side view showing the film member 51 according to the first embodiment of the present invention. FIG. 6 is a sectional view No. 1 of the image forming unit 12 showing an operation of the film member 51 according to the first embodiment of the present invention. FIG. 7 is a sectional view No. 2 of the image forming unit 12 showing the operation of the film member 51 according to the first embodiment of the present invention. FIG. 8 is an enlarged view of the image forming unit 12 showing the operation of the film member 51 according to the first embodiment of the present invention.

In the embodiment, the film member 51 is formed of a PET film having a thickness of 0.1 mm, and has a bent portion 51*a* bending at a right angle. Further, the film member 51 includes a fixing portion 51*g* as a base portion fixed at a fixing distal end portion 51*b*; a non-fixing portion 51*h* formed between the bent portion 51*a* and the fixing portion 51*g*; and a distal end portion 51*j* formed on a side of a free edge with respect to the bent portion 51*a*, or a side of a free distal end portion 51*c*.

In the embodiment, the film member 51 has a discharge opening opposing surface 51*d* or a supply opening opposing surface at the non-fixing portion 51*h* facing the discharge opening 45 (FIG. 1) and the supply opening 46. Further, the film member 51 has a fixing surface 51*e* to be fixed to the image forming unit main body 12*a* at the fixing portion 51*g*. More specifically, the fixing surface 51*e* is attached to an upper inner surface of a frame body of the image forming unit main body 12*a* with a fixing member such as adhesive, a double-sided tape, and the likes.

In the embodiment, the film member 51 has a developer supply member opposing surface 51*f* facing the toner supply roller 33 at the non-fixing portion 51*h*, and a boundary 51*i* between the fixing portion 51*g* and the non-fixing portion 51*h*. When the toner stirring member 47 rotates, the film member 51 displaces with the boundary 51*i* as a pivot.

In the embodiment, the film member 51 has a length a of 200 mm in a longitudinal direction thereof. A distance b from the fixing distal end portion 51*b* to the bent portion 51*a* is 30 mm. A width c of the fixing portion 51*g*, or a distance c from the fixing distal end portion 51*b* to the boundary 51*i*, is 10 mm. A length of the distal end portion 51*j*, or a distance e from the bent portion 51*a* to the free distal end portion 51*c*, is 5 mm.

An operation of the film member 51 will be explained next. When the toner cartridge 29 is attached to the image forming unit main body 12*a* and the lever is rotated, the shutter 42 rotates. Accordingly, toner is supplied to the toner retaining space 32 in the image forming unit main body 12*a* through the discharge opening 45 and the supply opening 46.

In the printing operation the rotation is transmitted to the gear 63 through the drive gear, the gears 66 and 67, the idle gear 65, and the gear 64. Accordingly, the toner stirring member 47 rotates in a clockwise direction in FIG. 6.

While the toner stirring member 47 is rotating, the rod member 47*a* interferes with the film member 51. Accordingly, the film member 51 displaces with the boundary 51*i* as a pivot between a side of the discharge opening 45 and the supply opening 46 and a side of the toner supply roller 33. When the film member 51 reaches a maximum displacement point on the side of the discharge opening 45 and the supply opening 46, a specific portion of the film member 51 or the free distal end portion 51*c* passes through the discharge opening 45 and the supply opening 46 into the toner storage space 31.

When the toner stirring member 47 rotates further, the rod member 47*a* does not interfere with the film member 51 any more. Accordingly, with elasticity thereof, the film member 51 displaces from a position indicated by a solid line to a position indicated by a hidden line in FIG. 6. At this time, the developer supply member opposing surface 51*f* pushes toner toward the toner supply roller 33 in a γ direction, and returns to an original position. Through the operation, the film member 51 supplies toner toward the toner supply roller 33. During the printing operation or a preparatory operation before the printing operation, the operation described above is repeated at a specific cycle.

In the embodiment, the toner stirring member 47 has an arm shape, and may have a spiral shape as a stirring member. When the toner stirring member 47 rotates, toner is transported in an axial direction. Accordingly, when a portion for interfering with the film member 51 upon rotating is integrally or separately formed at a specific portion of the toner stirring member 47, it is possible to displace the film member 51.

As described above, when the toner cartridge 29 is attached to the image forming unit main body 12*a*, the rod member 47*a* interferes with the film member 51. At this time, the shutter 42 interferes with the film member 51, so that the film member 51 becomes a state shown in FIG. 7 with elasticity thereof. Afterward, when the lever is rotated, the shutter 42 rotates in a counterclockwise direction in FIG. 7. Accordingly, the discharge opening 45 opens, and the film member 51 returns to the state shown in FIG. 6 with elasticity thereof.

In this case, when the distal end portion 51*j* has a too large length, the distal end portion 51*j* might be wound between the inner cylindrical member 41 and the outer cylindrical member 44 upon the rotation of the shutter 42. Accordingly, it is difficult to rotate the lever, or to return the film member 51 to the original state.

For example, as shown in FIG. 8, when the inner cylindrical member 41 rotates in a β direction, the discharge opening 45 is closed. At this time, an end portion 41*b* of the opening portion 41*a* (end portion on an upstream side in the rotational direction of the inner cylindrical member 41) moves and pushes the distal end portion 51*j* in the β direction. Accordingly, the distal end portion 51*j* might be wound between the inner cylindrical member 41 and the outer cylindrical member 44.

In view of the situation described above, in the embodiment, the distal end portion 51*j* has a length e smaller than a length L1 ($e<L1$). In this case, when the film member 51 becomes a state shown in FIG. 8, the bent portion 51*a* is away by the length L1 from an edge of an end portion 44*b* of the opening portion 44*a* on an inner circumferential surface side. With the configuration, when the toner cartridge 29 is replaced, and the inner cylindrical member 41 rotates in the β direction to close the discharge opening 45, it is possible to prevent the distal end portion 51*j* from being wound between the inner cylindrical member 41 and the outer cylindrical member 44.

As described above, when the toner stirring member 47 rotates, the distal end portion 51*j* repeatedly passes through the discharge opening 45 and the supply opening 46. Accordingly, even when a density of toner increases due to vibrations during transportation or own weight, and toner loses flowability in the toner cartridge 29, it is possible to prevent toner from being clogged near the discharge opening 45 and the supply opening 46. As a result, it is possible to supply a sufficient amount of toner from the toner cartridge 29 to the image forming unit main body 12*a*, thereby preventing a blurred image and improving image quality.

Further, in the embodiment, it is possible to supply a sufficient amount of toner to the image forming unit main body 12*a*. Accordingly, when a detection unit is provided in the image forming unit 12 for detecting an amount of toner, it is possible to prevent the detection unit from detecting shortage of toner too early. As a result, it is possible to stably operate the image forming unit 12.

Second Embodiment

A second embodiment of the invention will be described below. In the first embodiment, the film member 51 is bent at the right angle at the bent portion 51*a*. Accordingly, toner tends to accumulate inside the bent portion 51*a*. The accumulated toner is not supplied toward the toner supply roller 33 and becomes waste. Further, when the film member 51 displaces, toner may be filled in a space between the upper surface of the frame body of the image forming unit main body 12*a* and the film member 51. Accordingly, it is difficult to displace the film member 51 due to load of toner.

In the second embodiment, it is possible to prevent toner from accumulating inside the bent portion 51*a*. Components in the second embodiment similar to those in the first embodiment are designated by the same reference numerals, and explanations thereof are omitted.

Figure 9:
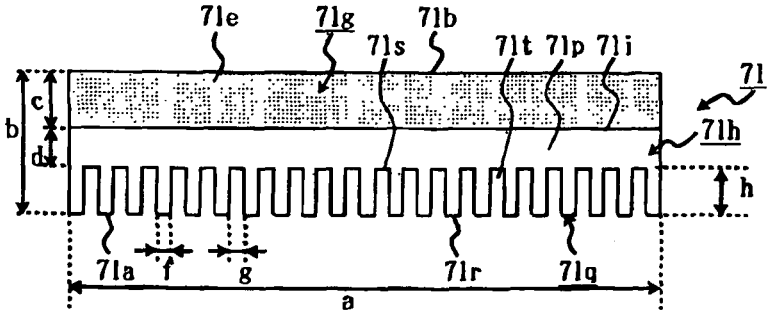
FIG. 9 is a schematic front view showing a film member according to a second embodiment of the present invention.
Figure 10:
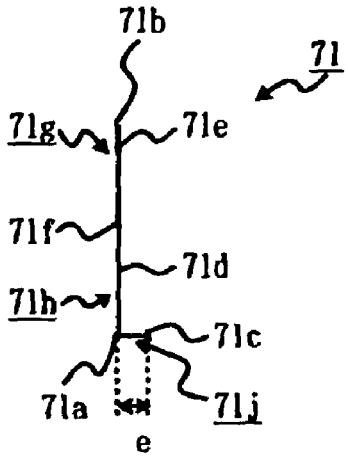
FIG. 10 is a schematic side view showing the film member according to the second embodiment of the present invention.
Figure 11:
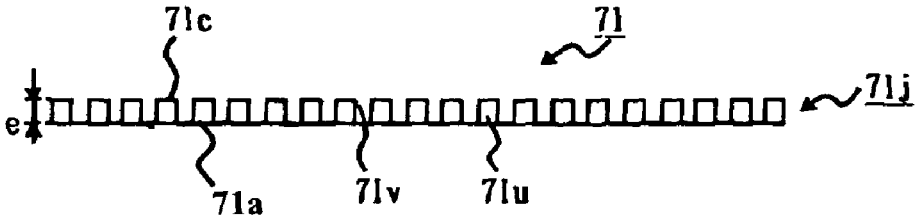
FIG. 11 is a schematic bottom view showing the film member according to the second embodiment of the present invention.
Figure 12:
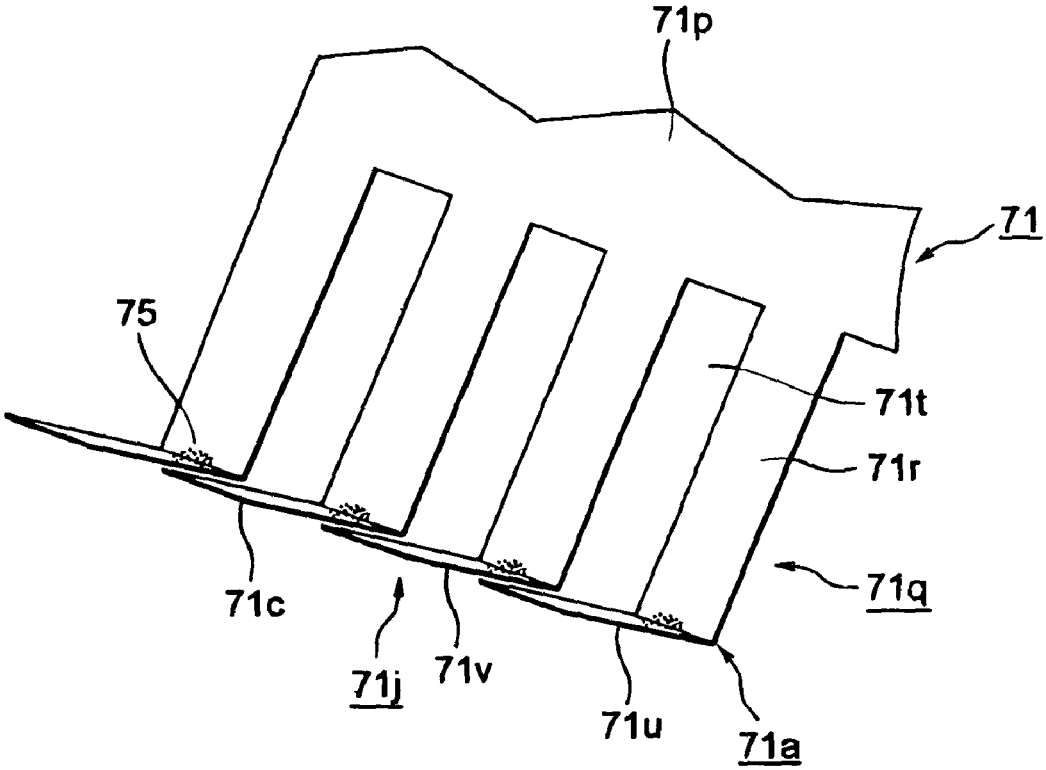
FIG. 12 is a schematic perspective view of the film member showing an accumulated state of toner according to the second embodiment of the present invention.

FIG. 9 is a schematic front view showing a film member 71 according to the second embodiment of the present invention. FIG. 10 is a schematic side view showing the film member 71 according to the second embodiment of the present invention. FIG. 11 is a schematic bottom view showing the film member 71 according to the second embodiment of the present invention. FIG. 12 is a schematic perspective view of the film member 71 showing an accumulated state of toner according to the second embodiment of the present invention.

In the embodiment, the film member 71 is formed of a PET film having a thickness of 0.2 mm, and has a bent portion 71*a* bending at a right angle. Further, the film member 71 includes a fixing portion 71*g* as a base portion fixed at a fixing distal end portion 71*b*; a non-fixing portion 71*h* formed between the bent portion 71*a* and the fixing portion 71*g*; and a distal end portion 71*j* formed on a side of a free edge with respect to the bent portion 71*a*, or a side of a free distal end portion 71*c*.

In the embodiment, the film member 71 has a discharge opening opposing surface 71*d* or a supply opening opposing surface at the non-fixing portion 71*h* facing the discharge opening 45 (FIG. 1) and the supply opening 46. Further, the film member 71 has a fixing surface 71*e* to be fixed to the image forming unit main body 12*a* at the fixing portion 71*g*. More specifically, the fixing surface 71*e* is attached to the upper inner surface of the frame body of the image forming unit main body 12*a* with a fixing member such as adhesive, a double-sided tape, and the likes.

In the embodiment, the film member 71 has a developer supply member opposing surface 71*f* facing the toner supply roller 33 at the non-fixing portion 71*h*, and a boundary 71*i* between the fixing portion 71*g* and the non-fixing portion 71*h*. When the toner stirring member 47 rotates, the film member 71 displaces with the boundary 71*i* as a pivot.

In the embodiment, the non-fixing portion 71*h* is formed of a flat plate member formed between the boundary 71*i* and a boundary 71*s*. The non-fixing portion 71*h* includes a first non-fixing portion 71*p* having a non-comb shape and a second non-fixing portion 71*q* having a comb shape formed between the first non-fixing portion 71*p* and the bent portion 71*a*. The second non-fixing portion 71*q* includes a plurality of teeth 71*r* with a constant interval and spaces 71*t* between the teeth 71*r*. The distal end portion 71*j* has a comb shape, and includes a plurality of teeth 71*u* with a constant interval integrated with the teeth 71*r* and spaces 71*v* between the teeth 71*u*.

In the embodiment, the film member 71 has a length a of 200 mm in a longitudinal direction thereof. A distance b from the fixing distal end portion 71*b* to the bent portion 71*a* is 30 mm. A width c of the fixing portion 71*g*, or a distance c from the fixing distal end portion 71*b* to the boundary 71*i*, is 10 mm. A distance h from the boundary 71*s* to the bent portion 71*a* is 15 mm. A distance d from the boundary 71*i* to the boundary 71*s* is 5 mm. A length of the distal end portion 71*j*, or a distance e from the bent portion 71*a* to the free distal end portion 71*c*, is 5 mm. A width f of the teeth 71*r* and 71*u* is 5 mm, and a width g of the spaces 71*t* and 71*v* is 5 mm.

An operation of the film member 71 will be explained next. When the toner cartridge 29 is attached to the image forming unit main body 12*a* and the lever is rotated, the shutter 42 rotates. Accordingly, toner as developer is supplied to the toner retaining space 32 as the developer retaining space in the image forming unit main body 12*a* through the discharge opening 45 and the supply opening 46.

In the printing operation, the rotation is transmitted to the gear 63 through the drive gear, the gears 66 and 67 (FIG. 3), the idle gear 65, and the gear 64. Accordingly, the toner stirring member 47 as the stirring member rotates in the clockwise direction in FIG. 6.

While the toner stirring member 47 is rotating, the rod member 47*a* interferes with the film member 71. Accordingly, the film member 71 displaces with the boundary 71*i* as a pivot between a side of the discharge opening 45 and the supply opening 46 and a side of the toner supply roller 33. When the film member 71 reaches a maximum displacement point on the side of the discharge opening 45 and the supply opening 46, the free distal end portion 71*c* passes through the discharge opening 45 and the supply opening 46 into the toner storage space 31 as the developer storage space.

When the toner stirring member 47 rotates further, the rod member 47*a* does not interfere with the film member 71 any more. Accordingly, with elasticity thereof, the film member 71 displaces from the position indicated by the solid line to the position indicated by the hidden line in FIG. 6. At this time, the developer supply member opposing surface 71*f* pushes toner toward the toner supply roller 33 in the γ direction, and returns to an original position. Through the operation, the film member 71 supplies toner toward the toner supply roller 33. During the printing operation or a preparatory operation before the printing operation, the operation described above is repeated at a specific cycle.

In the embodiment, the toner stirring member 47 has an arm shape, and may have a spiral shape as a stirring member. When the toner stirring member 47 rotates, toner is transported in an axial direction. Accordingly, when a portion for interfering with the film member 71 upon rotating is integrally or separately formed at a specific portion of the toner stirring member 47, it is possible to displace the film member 71.

As described above, when the toner cartridge 29 is attached to the image forming unit main body 12*a*, the rod member 47*a* interferes with the film member 71. At this time, the shutter 42 interferes with the film member 71, so that the film member 71 becomes the state shown in FIG. 7 with elasticity thereof. Afterward, when the lever is rotated, the shutter 42 rotates in the counterclockwise direction in FIG. 7. Accordingly, the discharge opening 45 opens, and the film member 71 returns to the state shown in FIG. 6 with elasticity thereof.

In this case, when the distal end portion 71*j* has a too large length, the distal end portion 71*j* might be wound between the inner cylindrical member 41 and the outer cylindrical member 44 upon the rotation of the shutter 42. Accordingly, it is difficult to rotate the lever, or to return the film member 71 to the original state.

For example, as shown in FIG. 8, when the inner cylindrical member 41 rotates in the β direction, the discharge opening 45 is closed. At this time, the end portion 41*b* of the opening portion 41*a* (FIG. 8) moves and pushes the distal end portion 71*j* in the β direction. Accordingly, the distal end portion 71*j* might be wound between the inner cylindrical member 41 and the outer cylindrical member 44.

In view of the situation described above, in the embodiment, the distal end portion 71*j* has a length e smaller than the length L1 (e<L1). In this case, when the film member 71 becomes a state shown in FIG. 8, the bent portion 71*a* is away by the length L1 from the edge of the end portion 44*b* of the opening portion 44*a* on the inner circumferential surface side. With the configuration, when the toner cartridge 29 is replaced, and the inner cylindrical member 41 rotates in the β direction to close the discharge opening 45, it is possible to prevent the distal end portion 71*j* from being wound between the inner cylindrical member 41 and the outer cylindrical member 44.

In the embodiment, the film member 71 includes the second non-fixing portion 71*g* and the distal end portion 71*j* having a comb shape with the spaces 71*t* and 71*v*, thereby preventing toner from accumulating at recess portions 75 inside the bent portion 71*a*. Accordingly, when the film member 71 displaces, and toner is filled in the space between the upper surface of the frame body of the image forming unit main body 12*a* and the film member 71, toner does not cause a large load for the film member 71 to displace.

In the embodiment, the teeth 71*r* and 71*u* have a width of 5 mm. Accordingly, it is possible to prevent toner from accumulating in the recess portions 75 due to vibrations applied to the toner stirring member 47.

In the embodiment, it is preferred to provide the teeth 71*r* and 71*u* as many as possible, so that it is possible to prevent toner from being clogged at the discharge opening 45 and the supply opening 46, and to effectively supply toner toward the toner supply roller 33. When the teeth 71*r* and 71*u* have a too small width, in the state that toner is filled in the space, toner may cause a large load for the film member 71 to displace. Accordingly, as described above, the teeth 71*r* and 71*u* have the width g of 5 mm and the length h of 15 mm.

In the embodiment, as described above, the teeth 71*r* and 71*u* have a comb shape, thereby reducing rigidity of the film member 71. Accordingly, the film member 71 has a thickness larger than the film member 51 in the first embodiment, i.e., 0.2 mm.

Third Embodiment

A third embodiment of the invention will be described below. Components in the third embodiment similar to those in the first and second embodiments are designated by the same reference numerals, and explanations thereof are omitted.

Figure 13:
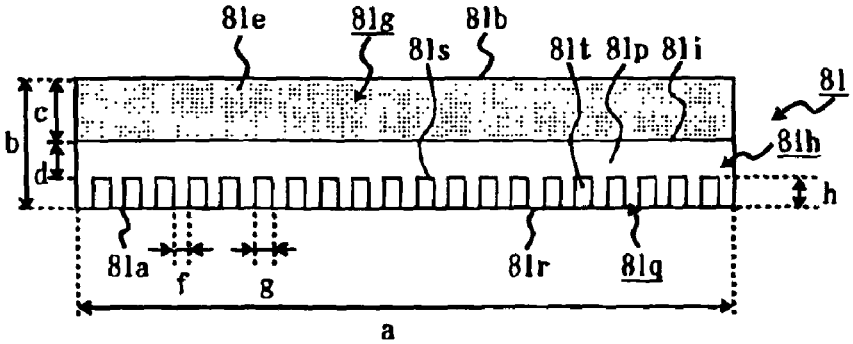
FIG. 13 is a schematic front view showing a film member according to a third embodiment of the present invention.
Figure 14:
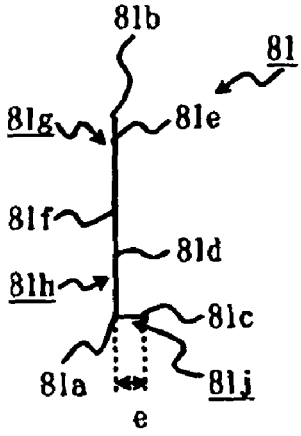
FIG. 14 is a schematic side view showing the film member according to the third embodiment of the present invention.
Figure 15:
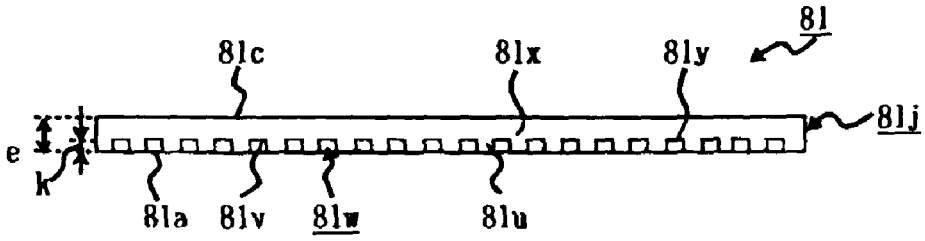
FIG. 15 is a schematic bottom view showing the film member according to the third embodiment of the present invention.
Figure 16:
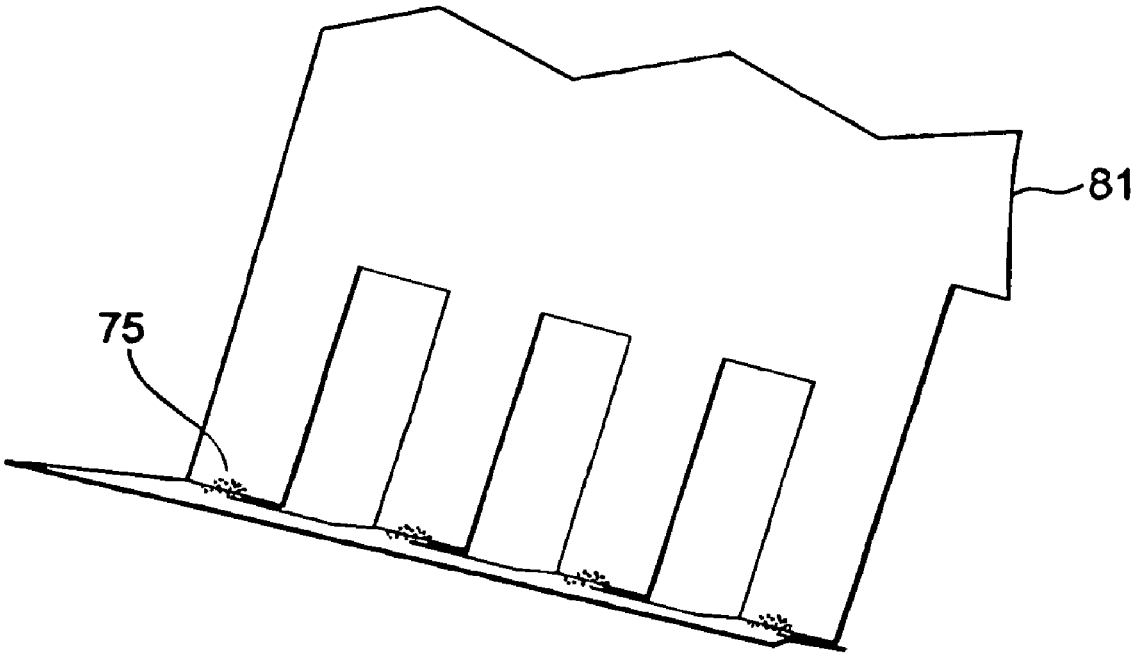
FIG. 16 is a schematic perspective view of the film member showing an accumulated state of toner according to the third embodiment of the present invention.

FIG. 13 is a schematic front view showing a film member 81 according to a third embodiment of the present invention. FIG. 14 is a schematic side view showing the film member 81 according to the third embodiment of the present invention. FIG. 15 is a schematic bottom view showing the film member 81 according to the third embodiment of the present invention. FIG. 16 is a schematic perspective view of the film member 81 showing an accumulated state of toner according to the third embodiment of the present invention.

In the second embodiment, the film member 71 has a larger thickness to compensate low rigidity thereof. Still, it may be difficult to optimize all of an amount of toner accumulated in the recess portions 75, the rigidity of the film member 71, the displacement of the film member 71, the load on the film member 71, and the toner transportation capability of the film member 71 through adjusting the thickness of the film member 71, the width f of the teeth 71*r* and 71*u*, the width g and length h of the spaces 71*t* and 71*v*, and the likes.

In the third embodiment, it is possible to solve the difficulty in the second embodiment. In the third embodiment, the film member 81 is formed of a PET film having a thickness of 0.2 mm, and has a bent portion 81*a* bending at a right angle. Further, the film member 81 includes a fixing portion 81*g* as a base portion fixed at a fixing distal end portion 81*b*; a non-fixing portion 81*h* formed between the bent portion 81*a* and the fixing portion 81*g*; and a distal end portion 81*j* formed on a side of a free edge with respect to the bent portion 81*a*, or a side of a free distal end portion 81*c*.

In the embodiment, the film member 81 has a discharge opening opposing surface 81*d* or a supply opening opposing surface at the non-fixing portion 81*h* facing the discharge opening 45 (FIG. 1) and the supply opening 46. Further, the film member 81 has a fixing surface 81*e* to be fixed to the image forming unit main body 12*a* at the fixing portion 81*g*. More specifically, the fixing surface 81*e* is attached to the upper inner surface of the frame body of the image forming unit main body 12*a* with a fixing member such as adhesive, a double-sided tape, and the likes.

In the embodiment, the film member 81 has a developer supply member opposing surface 81*f* facing the toner supply roller 33 at the non-fixing portion 81*h*, and a boundary 81*i* between the fixing portion 81*g* and the non-fixing portion 81*h*. When the toner stirring member 47 as the rotational member or the stirring member rotates, the film member 81 displaces with the boundary 81*i* as a pivot.

In the embodiment, the non-fixing portion 81*h* is formed of a flat plate member formed between the boundary 81*i* and a boundary 81*s*. The non-fixing portion 81*h* includes a first non-fixing portion 81*p* having a non-comb shape and a second non-fixing portion 81*q* having a comb shape formed between the boundary 81*s* and the bent portion 81*a*. The second non-fixing portion 81*q* includes a plurality of bridges 81*r* with a constant interval and holes 81*t* between the bridges 81*r*. The distal end portion 71*j* has a comb shape, and includes a plurality of teeth 71*u* with a constant interval integrated with the teeth 71*r* and spaces 71*v* between the teeth 71*u*.

In the embodiment, the distal end portion 81*j* includes a first distal end portion 81*w* having a comb shape formed between the bent portion 81*a* and the boundary 81*y* and a second distal end portion 81*x* having a flat plate portion formed between the boundary 81*y* and the free distal end portion 81*c*. The first distal end portion 81*w* includes a plurality of bridges 81*u* with a constant interval integrated with the bridges 81*r* and holes 81*v* between the bridges 81*u*.

In the embodiment, the film member 81 has a length a of 200 mm in a longitudinal direction thereof. A distance b from the fixing distal end portion 81*b* to the bent portion 81*a* is 30 mm. A width c of the fixing portion 81*g*, or a distance c from the fixing distal end portion 81*b* to the boundary 81*i*, is 10 mm. A distance d from the boundary 81*i* to the boundary 81*s* is 5 mm. A distance h from the boundary 81*s* to the bent portion 81*a* is 15 mm. A length of the distal end portion 81*j*, or a distance e from the bent portion 81*a* to the free distal end portion 81*c*, is 5 mm. A distance k from the bent portion 81*a* to the boundary 81*y* is 2 mm. A width f of the bridges 81*r* and 81*u* is 5 mm, and a width g of the holes 81*t* and 81*v* is 5 mm.

In the embodiment, the film member 81 includes the holes 81*t* and 81*v*, and end portions of the holes 81*t* and 81*v* are connected through the second distal end portion 81*x*. Accordingly, it is possible to increase rigidity of the film member 81.

In the embodiments described above, the printer is explained as the image forming apparatus. The present invention is applicable to an image forming apparatus such as a copier, a facsimile, a multi-function product, and the likes.

The disclosure of Japanese Patent Application No. 2007-006024, filed on Jan. 15, 2007 is incorporated in the application by reference.

While the invention has been explained with reference to the specific embodiments of the invention, the explanation is illustrative and the invention is limited only by the appended claims.

What is claimed is:

1. An image forming unit comprising:

an image forming unit main body including a developer retaining space for retaining developer and a supply opening for supplying the developer to the developer retaining space;

a developer storage unit detachably attached to the image forming unit main body, said developer storage unit including a discharge opening for discharging the developer to the developer retaining space;

a rotational mechanism arranged in the image forming unit main body to be rotatable; and a movable member disposed in the image forming unit main body for moving relative to the discharge opening and the supply opening, said movable member including one end portion attached to an inner wall of the image forming unit main body and a distal end portion as a free end, said distal end portion being arranged to repeatedly contact with and separate from the rotational mechanism according to a rotation of the rotational mechanism, said distal end portion including a bent portion extending into the developer storage unit through the supply opening and the discharge opening when the distal end portion contacts with the rotational mechanism.

2. The image forming unit according to claim 1, wherein said movable member is formed of a film member.

3. The image forming unit according to claim 1, wherein said rotational mechanism includes a stirring mechanism for stirring the developer retained in the developer retaining space.

4. The image forming unit according to claim 2, wherein said distal end portion has a comb shape.

5. The image forming unit according to claim 2, wherein said distal end portion has a plurality of spaces.

6. The image forming unit according to claim 2, wherein said distal end portion has a plurality of holes.

7. The image forming unit according to claim 1, wherein said movable member is arranged to move the distal end portion relative to the supply opening and the discharge opening between an inserted state and a non-inserted state.

8. An image forming unit comprising:

a developer retaining space for retaining developer;

a frame member for dividing the developer retaining space;

an opening portion formed in the frame member for supplying the developer to the developer retaining space;

a rotational mechanism arranged in the frame member to be rotatable; and a movable member disposed to be movable relative to the opening portion, said movable member including a distal end portion extending into the developer retaining space through the opening portion, said movable member including one end portion attached to the frame member and a distal end portion as a free end, said distal end portion being arranged to repeatedly contact with and separate from the rotational mechanism according to a rotation of the rotational mechanism, said distal end portion including a bent portion extending into the developer retaining space through the opening portion when the distal end portion contacts with the rotational mechanism.

9. The image forming unit according to claim 8, wherein said movable member is formed of a film member.

10. The image forming unit according to claim 8, wherein said movable member is arranged to move the distal end portion relative to the opening portion between an inserted state and a non-inserted state.

11. An image forming apparatus comprising:

a medium storage unit for storing a medium;

a transportation mechanism for transporting the medium;

an image forming unit for forming a developer image;

a transfer unit for transferring the developer image to the medium; and a fixing unit for fixing the developer image on the medium, wherein said image forming unit includes, an image forming unit main body including a developer retaining space for retaining developer and a supply opening for supplying the developer to the developer retaining space;

a developer storage unit detachably attached to the image forming unit main body, said developer storage unit including a discharge opening for discharging the developer to the developer retaining space;

a rotational mechanism arranged in the image forming unit main body to be rotatable; and a movable member disposed in the image forming unit main body for moving relative to the discharge opening and the supply opening, said movable member including one end portion attached to an inner wall of the image forming unit main body and a distal end portion as a free end, said distal end portion being arranged to repeatedly contact with and separate from the rotational mechanism according to a rotation of the rotational mechanism, said distal end portion including a bent portion extending into the developer storage unit through the supply opening and the discharge opening when the distal end portion contacts with the rotational mechanism.

12. The image forming apparatus according to claim 11, wherein said movable member is formed of a film member.

13. The image forming apparatus according to claim 11, wherein said rotational mechanism includes a stirring mechanism for stirring the developer retained in the developer retaining space.

14. The image forming apparatus according to claim 12, wherein said distal end portion has a comb shape.

15. The image forming apparatus according to claim 12, wherein said distal end portion has a plurality of spaces.

16. The image forming apparatus according to claim 12, wherein said distal end portion has a plurality of holes.

17. The image forming apparatus according to claim 11, wherein said movable member is arranged to move the distal end portion relative to the supply opening and the discharge opening between an inserted state and a non-inserted state.

* * * * *